US010295127B2

(12) United States Patent
Perez et al.

(10) Patent No.: US 10,295,127 B2
(45) Date of Patent: May 21, 2019

(54) LUMINAIRE ASSEMBLY

(71) Applicant: Carbi Limited, Tsim Sha Tsui (HK)

(72) Inventors: Pedro Jose Albaladejo Perez, Alguazas (ES); Joaquin Vicente Bravo, Alguazas (ES); Jorge Carlos Navarro Saldana, Terrassa (ES)

( * ) Notice: Subject to any disclaimer, the term of this patent is extended or adjusted under 35 U.S.C. 154(b) by 0 days.

(21) Appl. No.: 15/705,257

(22) Filed: Sep. 14, 2017

(65) Prior Publication Data

US 2019/0078739 A1 Mar. 14, 2019

(51) Int. Cl.

| | |
|---|---|
| ***F21V 9/00*** | (2018.01) |
| ***F21K 9/64*** | (2016.01) |
| ***F21V 19/00*** | (2006.01) |
| ***F21V 29/70*** | (2015.01) |
| ***F21K 9/68*** | (2016.01) |
| ***F21V 5/00*** | (2018.01) |
| ***F21V 3/00*** | (2015.01) |
| *F21Y 115/10* | (2016.01) |

(52) U.S. Cl.

CPC ..... *F21K 9/64* (2016.08); *F21K 9/68* (2016.08); *F21V 3/00* (2013.01); *F21V 5/007* (2013.01); *F21V 19/0015* (2013.01); *F21V 29/70* (2015.01); *F21Y 2115/10* (2016.08)

(58) Field of Classification Search

CPC ... F21K 9/64; F21K 9/68; F21V 29/70; F21V 3/00; F21V 5/07; F21V 19/0015; F21Y 2115/10

USPC ..... 362/84

See application file for complete search history.

(56) References Cited

U.S. PATENT DOCUMENTS

| | | | | |
|---|---|---|---|---|
| 8,187,097 | B1 * | 5/2012 | Zhang | A63F 13/52 463/37 |
| 2017/0227208 | A1 * | 8/2017 | Bendtsen | F21V 29/83 |
| 2017/0374724 | A1 * | 12/2017 | Liszt | H05B 37/0272 |
| 2018/0128961 | A1 * | 5/2018 | Lim | G02B 6/0055 |

* cited by examiner

*Primary Examiner* — Karl D. Frech

(74) *Attorney, Agent, or Firm* — Austin T Cairns

(57) ABSTRACT

A luminaire assembly having a housing containing a light assembly therein is disclosed. A control board is engaged with wide angle and spot LED's. Each wide angle LED is within a mixing chamber having a remote phosphor. The LED's are positioned outside the plane of the front cover such that a full peripheral emission of light is emitted from the luminaire, fully illuminating the user's surroundings.

9 Claims, 14 Drawing Sheets

LUMINAIRE ASSEMBLY

FIELD OF THE INVENTION

The present invention relates to the field of light-emitting diodes (LED's) and luminaire configurations and assemblies thereof.

BACKGROUND OF THE INVENTION

Light-emitting diodes ("LED's") are a popular form of light source due to their low energy consumption, longer lifespan, small size, and fast switching properties. Each of these make them an ideal choice for small and mobile applications such as headlamps, flashlights, and similar user-engaged lighting means. Many will recognize that LED's are a light source for headlamps. These headlamps are worn by users such as hikers, construction workers, and other operating in low light environment.

A main drawback with LED headlamps, and similar applications is that the LED emits light with limited angular direction from the source. This produces a "tunnel" of direct and intense light from the source while leaving the periphery void of useful light. In the current art, conventional headlamp LED's have a wide angle LED to provide ambient light at a wide angle in reference to the vector of the user. These components are oriented to emit light parallel with respect to the line of sight of the user. They also employ a spot LED to focus light at a greater distance, creating a "tunnel" of light which protrudes further than light emitted by the wide angle LED. These work well for many uses, however, new innovation in the art is desired.

It can be seen that an innovation in the field of light-emitting diodes is needed to provide users with a broad emittance of light from the source in order to illuminate a larger portion of the user's field of vision.

SUMMARY OF THE INVENTION

In an embodiment, a luminaire assembly has a housing with a front and back cover containing a light assembly therein. The light assembly has a control board operably engaged with one or more wide angle LED's and at least one spot LED. One or more mixing chambers, each of which having a remote phosphor have at least one wide angle LED therein. Each remote phosphor is retained by a holder. The spot lens is positioned over each spot LED. Light emitted through each of the one or more transparent surfaces on the front over. Light from the spot LED is emitted through each of the at least one spot LED lenses, and further through at least one of the one or more transparent surfaces. The luminaire assembly is operably configured to illuminate more than 180° in a horizontal plane.

In an embodiment each wide angle LED and mounted to a board, and wherein the board is comprised of reflective surface.

In an embodiment, each light assembly is positioned on a pillar extending from the back cover, and each pillar transfers heat to the back cover.

In an embodiment, each light assembly is removably engaged with the a pillar and in a further embodiment, each pillar extends through an aperture on the control board. each pillar may be thermoconductive and transfers heat to the back cover. In this manner, the back cover is configured to be a heat sink.

In an embodiment, the control board is manipulated by a control switch positioned on the housing.

In an embodiment, the housing is configured to be mounted to a surface.

In an embodiment, the front and back cover sealingly engage to contain the assembly therein.

In an embodiment, the holder has at least one remote phosphor retainer and at least one spot LED lens retainer.

In an embodiment, each of the at least one transparent surfaces extends to the outside of a vertical plane of the front cover, and each of the remote phosphors within the housing are positioned outside of the vertical plane of the front cover such that light emitted by each of the remote phosphors is obstructed by the housing by the less than 180° vertically and 180° horizontally. In an embodiment, each light assembly is removably engaged with the housing.

BRIEF DESCRIPTION OF THE DRAWINGS

Various embodiments of the invention are disclosed in the following detailed description and accompanying drawings.

DETAILED DESCRIPTION AND PREFERRED EMBODIMENT

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured. For the purpose of clarity, the use of the term "device" refers to the invention as a whole and all of its components therein.

In general, the invention described herein relates to a light-emitting diode ("LED") assembly for the purposes of providing the user with and emitting an illuminated wide angle view of their surroundings. For the purposes of clarity, the main embodiment described herein is affixed to a headwear article and used as a headlamp. One skilled in the art will appreciate that the LED assembly may be utilized in a variety of applications where an illuminated wide viewing field is desired. Further, it can be appreciated that the assembly disclosed herein not only be used as a headlamp, but for a multitude of application without altering the spirit of the invention.

Figure 1:
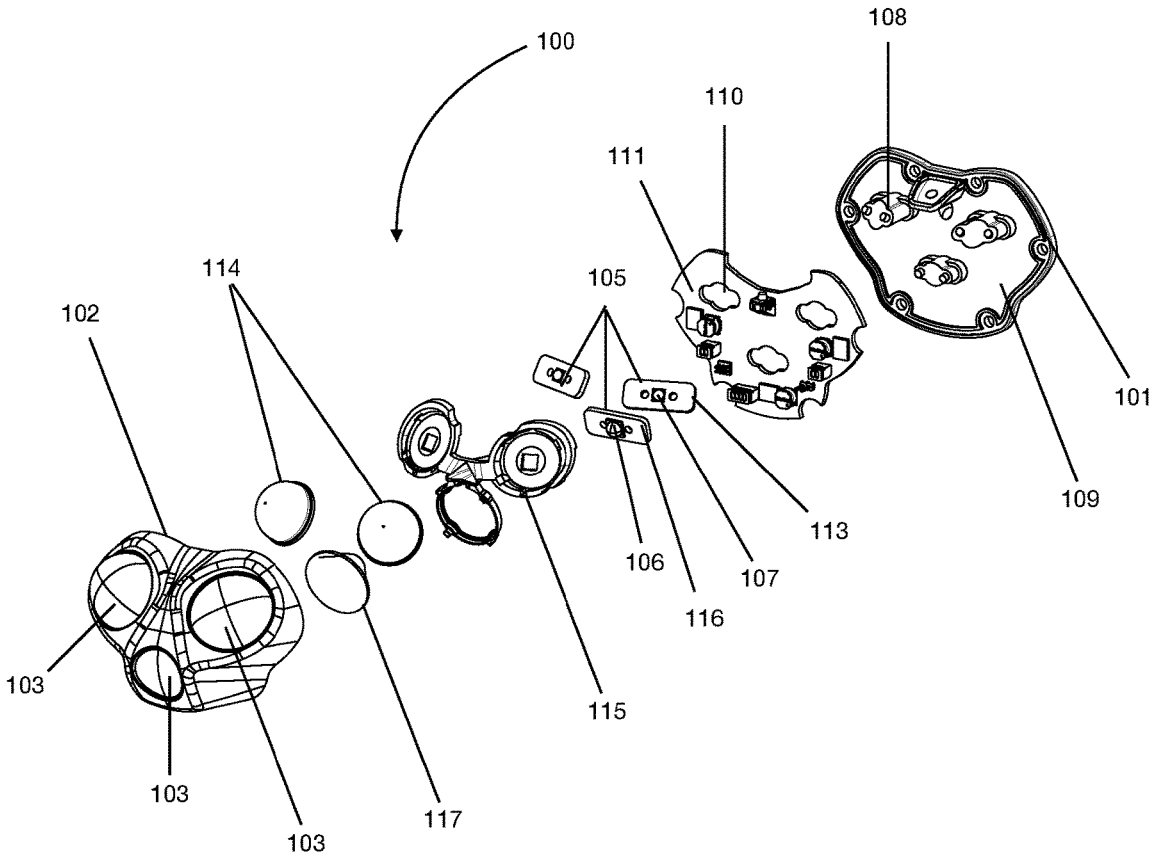
FIG. 1. illustrates an exploded view of the luminaire components, according to an embodiment of the present invention.
Figure 2:
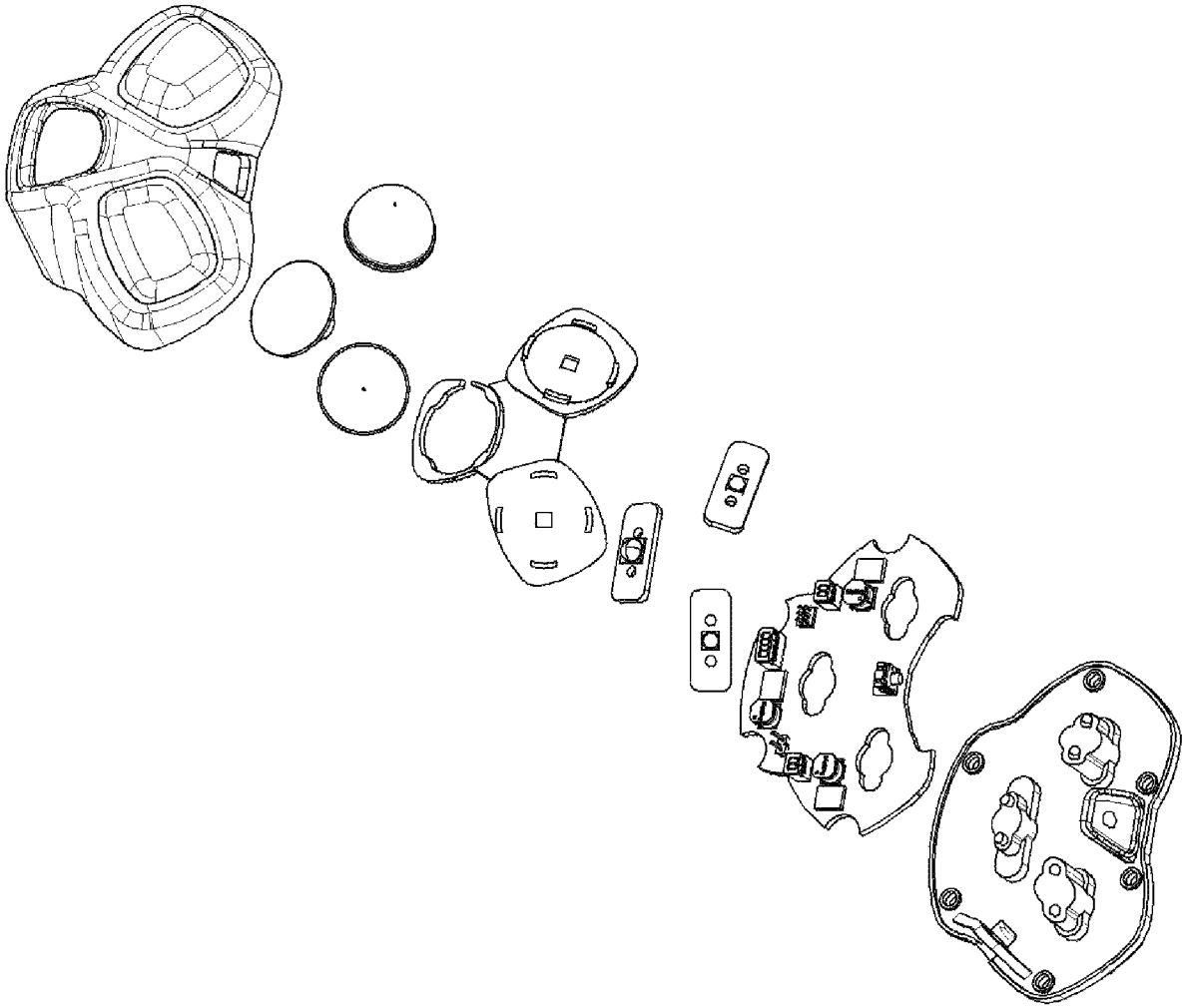
FIG. 2. illustrates an exploded view of the luminaire components, according to an embodiment of the present invention.

In reference to FIG. 1 and FIG. 2, an exploded view of the luminaire 100 configuration is illustrated in an embodiment of the present invention. In general, the luminaire 100 has a housing formed by a back cover 101 and front cover 102 substantially sealingly engaged to protect the contents therein from foreign elements which may cause damage. The front and back covers 102, 101 may be connected using a plurality of fasteners, adhesive, or semi-integral or integral molding, among other techniques known in the art. The front cover 102 is designed to allow light to ingress and egress of light emitted by at least one light source 105 through one or more front transparent surfaces 103. In the present invention, the light source may be defined as an one or more LED's, including spot LED's 106 and wide angle LED's 107. The two types of LED light sources are intended to work in unison such that a wide angle of light is emitted as well as a focused column of light is emitted to illuminate a user's surroundings both near and far.

The back cover 101 functions in unison with the front cover to protect the interior components from foreign elements which may damage the function of the luminaire. Further, the back cover 101 serves as a heat sink in order to draw heat away from the light source to the outside of the luminaire 100 to aide in cooling the luminaire during use. The back cover has one or more pillars 108 extending substantially perpendicular from the flat planar surface 109 of the back cover 101. Each pillar 108 extends through a corresponding pillar aperture 110 on a control board 111 such that the control board 111 is positioned near the back cover 101. The planar surfaces of the back cover 101 and control board 111 rest substantially parallel to each other when the luminaire 100 is assembled. The control board 111 is contained within the housing formed by the front and back covers 102, 101 of the luminaire 100 when in use.

In an embodiment, each LED assembly may be mounted directly to the back cover, forgoing the utilization of the pillar as a mounting means. Without the use of the pillars, each LED assembly is mounted on the planar surface of the back cover.

In a preferred embodiment, each pillar 108 extends through the pillar aperture 110 to be in communication with the light sources 105. Each pillar 108 may be connected to the light source 105 by a two sided thermal pad 402, or other connection thermal conductive means known in the art such as thermal adhesive, thermal glue, screws, among others as well as combinations thereof. In this manner, each light source 105 is independently mounted to one of the pillars 108 to promote a directional heat transfer towards the back cover 101 of the luminaire 100.

In further reference to FIG. 1 and FIG. 2, and in a preferred embodiment, light sources 105 include both wide angle LED's 107 and spot LED's 106 to achieve the intended functionality of the device. A wide angle LED board 113 are positioned on a surface of each pillar 108 and in electrical communication with the control board 111 as known in the arts. Each wide angle board 113 has one or more blue LED's 107 positioned on a front surface thereon. Each wide angle LED 107 is dedicated to emitting blue light to a corresponding remote phosphor dome 114. In front, with respect to the front cover 102, of the wide angle board 113 is a remote phosphor holder 115 retaining the remote phosphor dome 114 in position. Each wide angle board 113 has a flat back surface in contact with it's respective pillar 108.

Furthermore, one or more spot light boards 116 are utilized in the luminaire to emit long range light to illuminate objects at a distance. The spot light board 116 has at least one spot LED 106 emitting white light towards a spot lens 117 that focuses light at a distance as known in the art. Similar to the wide angle LED board, each spot light board 116 has a flat back surface affixed to a specific pillar 108. Each spot LED 106 is electrically connected to the control board 111. The spot lens 117 is retained on the spot light board 116 by a spot lens holder 118. Unlike the wide angle LED assemblies, the spot angle LED is not in communication with a remote phosphor.

In further reference to FIG. 1, each remote phosphor may be shaped as a dome or semi-dome and is adapted to convert blue light emitted by the blue LED's 107 on the wide angle LED board 113 to visible white light, as known in the arts. In alternate embodiment, each remote phosphor dome may be shaped as any concave or convex surface so the light is projected in a wider space field. The user may be provided with any number of shapes of remote phosphor domes as part of a set or kit allowing the user to interchange the domes for different applications and preferences. This functions to emit light through the one or more transparent surfaces 103 positioned on the front cover, permitting light to egress therethrough. To achieve the intended field of view while the luminaire 100 is in use, each remote phosphor 114 is affixably oriented in a specific direction, both horizontally and vertically, such that a wide angle viewing field is emitted. Each remote phosphor dome 114 is selected to have a specific phosphor coating, allowing for the user to interchange the remote phosphor to emit different spectrums for specific applications. In this manner, a plurality of remote phosphor domes 114 may be provided as one of a set or kit, allowing the user to interchange quickly as needed. In this embodiment, the remote phosphor dome is releasably engaged with the remote phosphor holder 115.

In a preferred embodiment, each remote phosphor domes holder has one or several apertures corresponding with the wide angle board's LED's to allow the LED's light be emitted, and creating a mixing chamber between the remote dome and the remote dome holder. For this purpose the remote dome holder has a high reflective surface as an intermediate to the printed circuit board ("PCB") in order to recycle the maximum of the light reflected back by the remote phosphor.

In an embodiment, the light source is positioned directly on the circuit board without a reflective intermediary. The mixing chamber wherein the light source is positioned is configured to recycle light such that efficiency is conserved.

In a preferred embodiment, the front cover 102 is releasably connected to each of the remote phosphor domes 114 and spot light lens 117. The front cover has at least one aperture positioned through an opaque frame. In a preferred embodiment two apertures are positioned through the frame, and transparent surfaces are positioned about the perimeter of the aperture to shield the remote phosphor domes positioned therein.

In a preferred embodiment, the luminaire 100 has adjacent wide light board assemblies which include the wide angle board 113 and wide angle LED's 107. This allows for the corresponding remote phosphor domes 114 to be positioned such that the broadest viewing angle is achieved by the luminaire 100.

The control board 111 is in electrical communication with a control switch 120 positioned on the front cover 102 of the housing. During use, the user may engage with the control switch 120 to modify the various functions of the device. These functions may include, but are not limited to; ON/OFF, light intensity between 0% and 100%, strobe, light color, among other settings known in the arts.

Wide angle LED's illuminate a broad field which is intended to cover a majority, preferentially all, of the user's field of vision. The spot LED is intended to illuminate far away objects, not illuminated by the wide angle LED's. In an alternate embodiment, spot LED's are not used with the luminaire assembly and only wide angle LED's are utilized.

Figure 3:
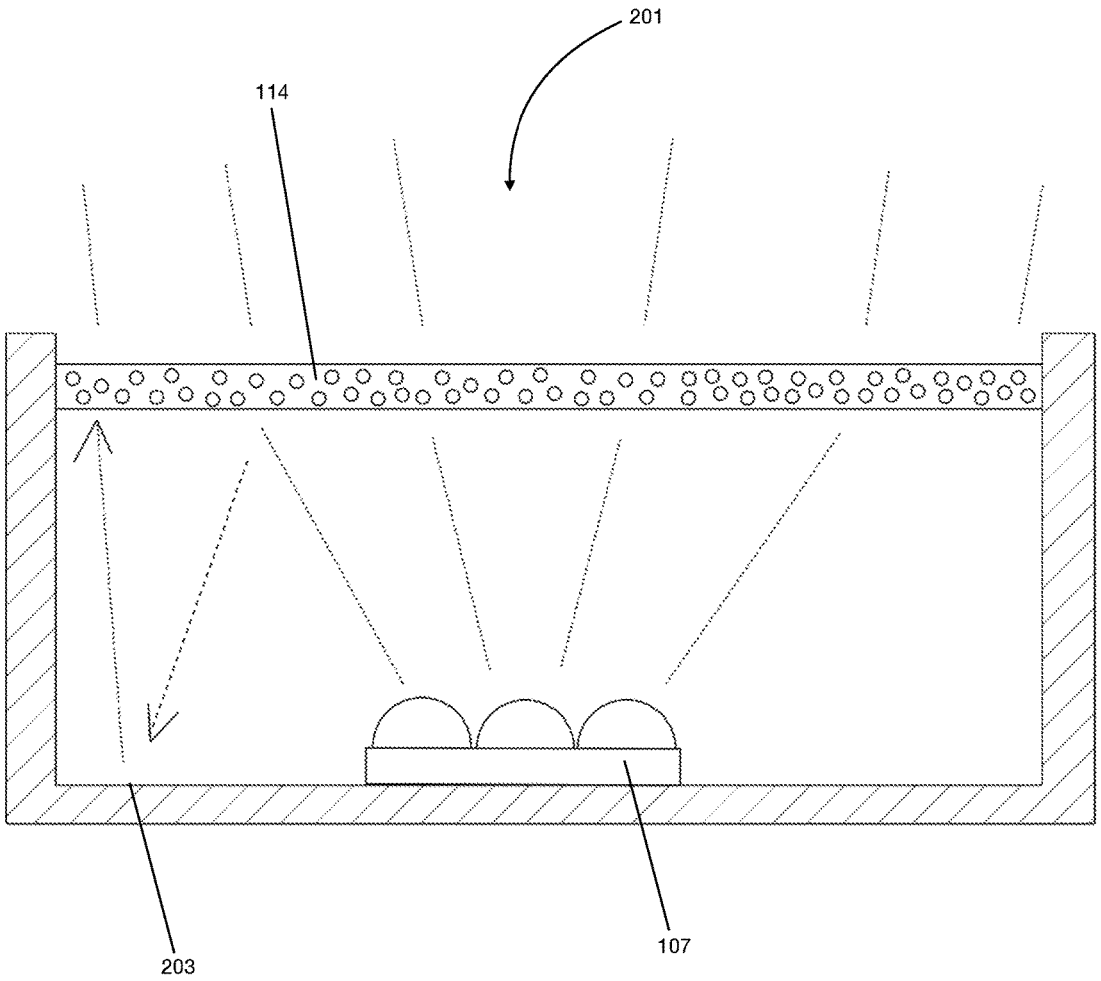
FIG. 3. illustrates a schematic of the light source, mixing chamber and remote phosphor, according to an embodiment of the present invention.
Figure 4:
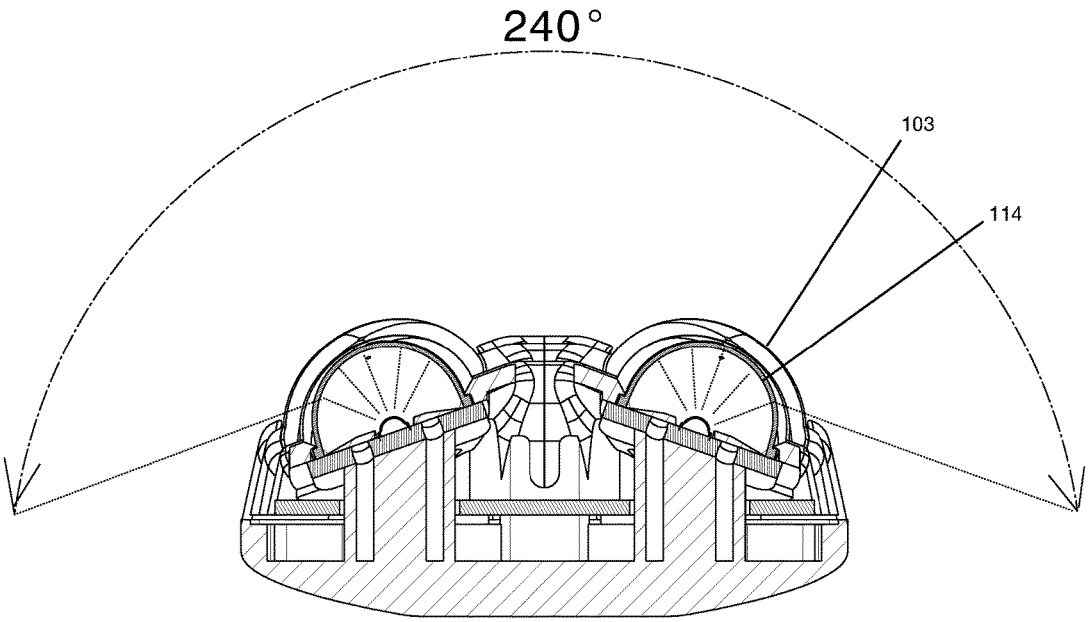
FIG. 4. illustrates a top plan view of the luminaire, according to an embodiment of the present invention.

Now referring to FIG. 3 and FIG. 4, each LED 107 may be positioned within a mixing chamber 201 wherein blue LED light is emitted towards the remote phosphor 114. The remote phosphor 114, which is preferentially dome shaped to emit light at a wide angle, transforms blue light into visible white light, emitting white light at a wide angle therefrom. The dome geometry also has the advantage to place the remote phosphor surface equidistant to the light emitter, so the light is uniformly or evenly emitted to outside. FIG. 3 illustrates a preferred embodiment, wherein two adjacently positioned remote phosphor domes 114, each having blue light emitting LED's therein are oriented on their respective pillars 108 to emit wide angle light. In an embodiment, each remote phosphor dome is contained within a transparent protector 301. Each remote phosphor dome partially extends out of the opaque surfaces of the front cover 102 (see FIG. 1) such that light may be emitted at a wide angle through the pair of transparent surfaces 103 (FIG. 1).

In embodiments, any number of LED's may be positioned within the mixing chamber to emit light to stimulate the remote phosphor. More LED's within the mixing chamber will result in more light emitted.

Figure 5:
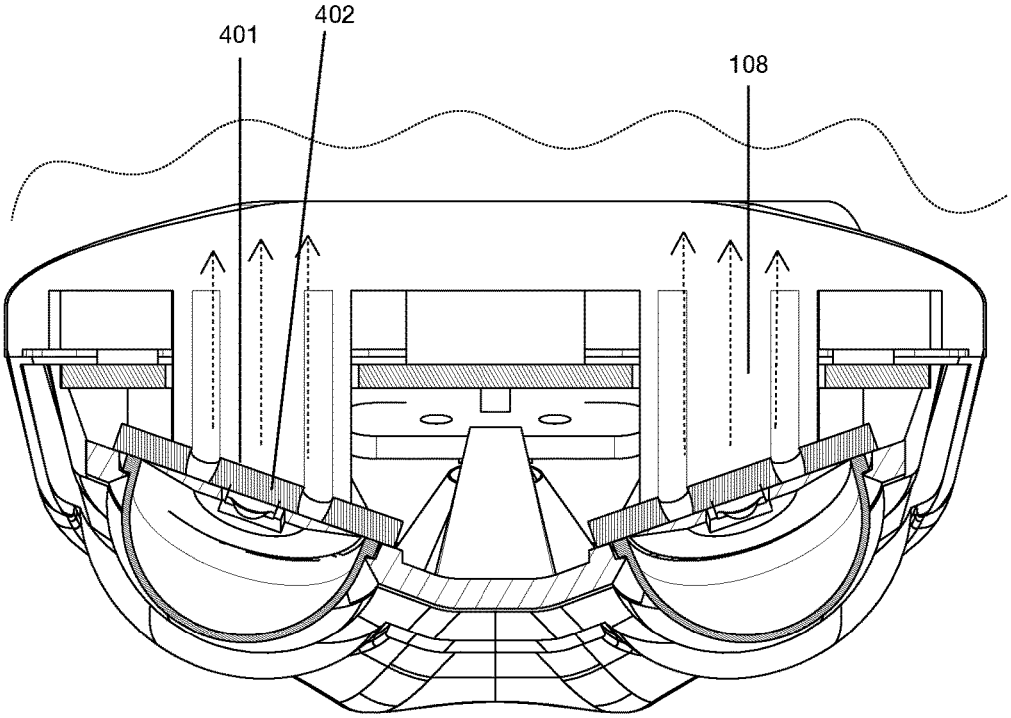
FIG. 5. illustrates a top plan view of the luminaire, according to an embodiment of the present invention.
Figure 6:
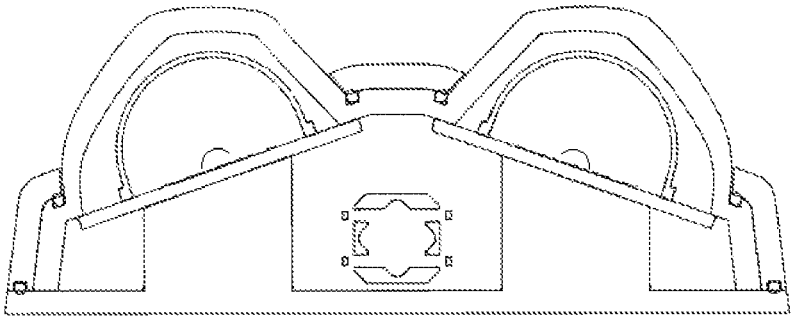
FIG. 6. illustrates a top plan view of the luminaire, according to an embodiment of the present invention.
Figure 7:
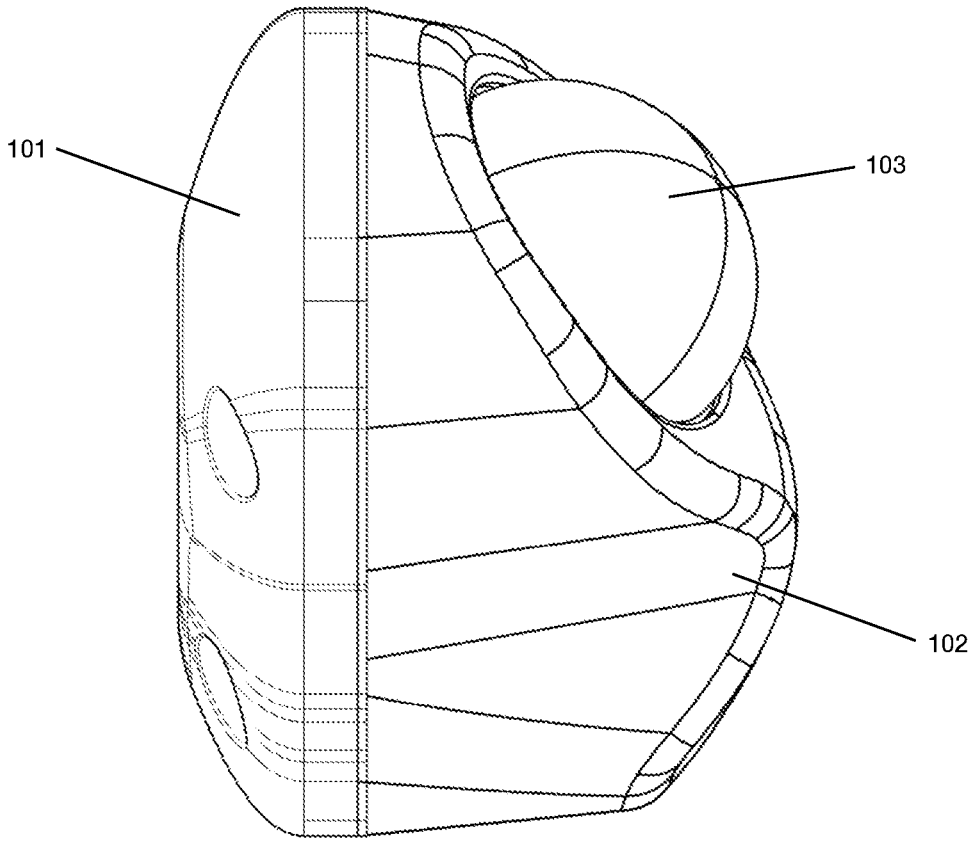
FIG. 7. illustrates a side elevation view of the luminaire, according to an embodiment of the present invention.
Figure 8:
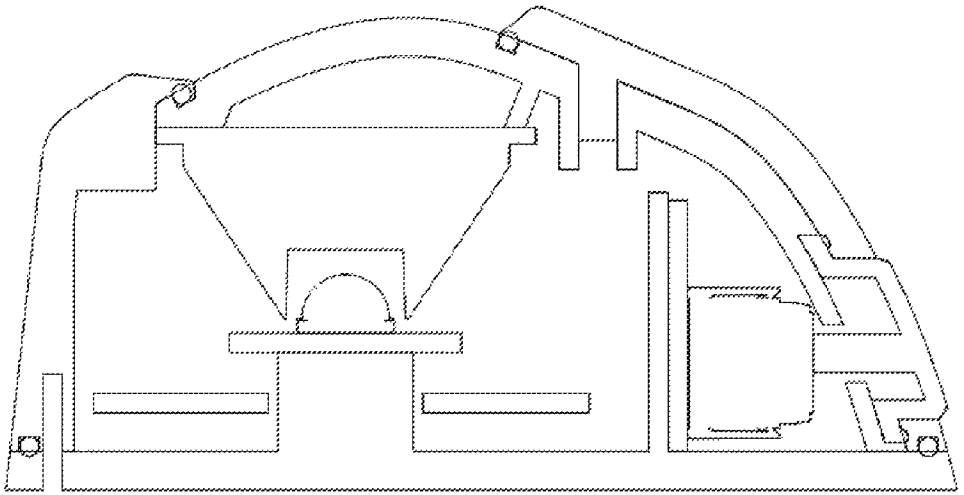
FIG. 8. illustrates a side elevation view of the luminaire, according to an embodiment of the present invention.
Figure 9:
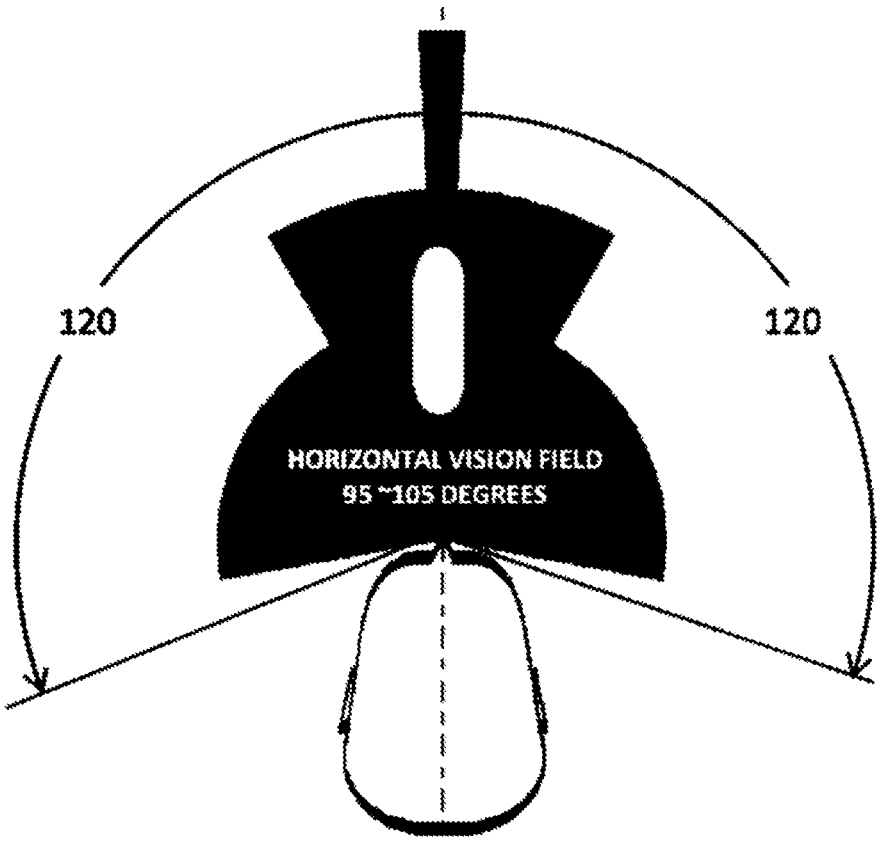
FIG. 9. illustrates a to plan view of the users viewing field, according to an embodiment of the present invention.
Figure 10:
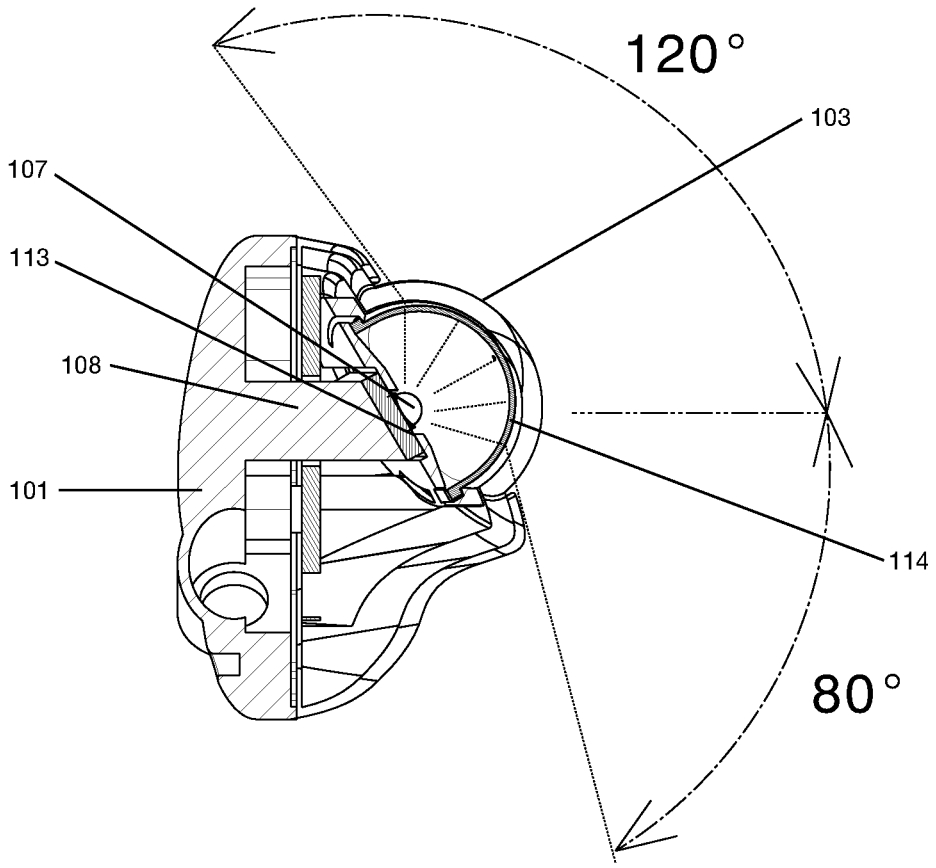
FIG. 10. illustrates a side elevation view of the luminaire, according to an embodiment of the present invention.

In reference to FIG. 5 and FIG. 6, a top sectional view of the internal assembly 400 is illustrated, in an embodiment of the present invention. Each LED 107, is positioned on the surface 401 of it's respective pillar 108. Adhesion is achieved by a thermal pad 112 positioned between the back surface and thermal pad 402 of the LED board. Heat emitted by the LED's 107 is substantially transferred along directional axis 403. To accomplish this heat transfer, the back cover 101 and pillars 108 extending therefrom are made of a material having a high heat conductivity, such as aluminum. As heat moves away from the LED to the back cover 101, the heat is transferred to exterior air removing energy from the luminaire 100, and thus cooling the assembly during use. Similarly, heat from the spot light LED 106 is transferred through it's respective pillar 108 to the back cover 101. Positioning each individual LED 107, 106 on an individual pillar 108 helps to reduce the overall weight of the luminaire 101. This weight reduction is crucial, especially for embodiments such as the headlamp where the user is wearing the luminaire 101 on their head.

Figure 11:
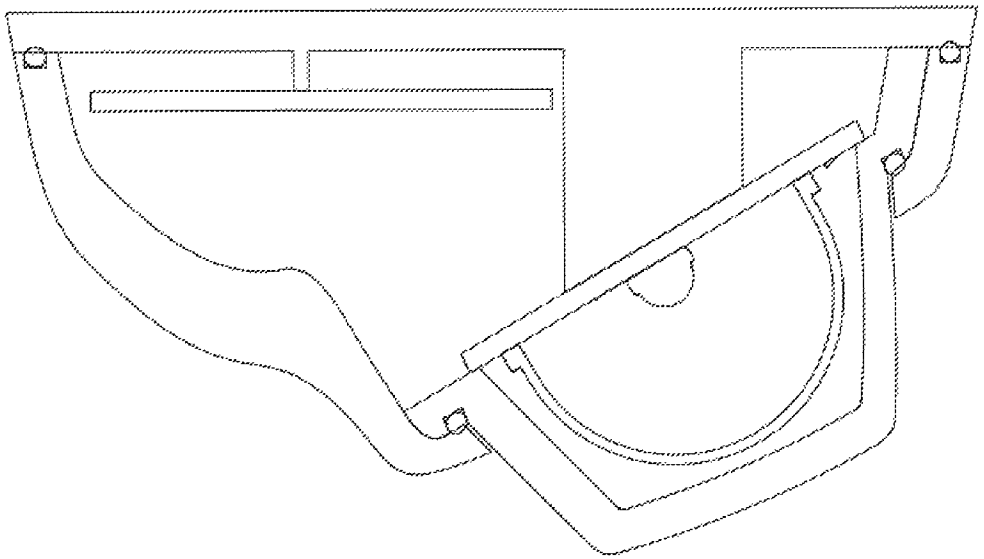
FIG. 11. illustrates a side elevation view of the luminaire, according to an embodiment of the present invention.
Figure 12:
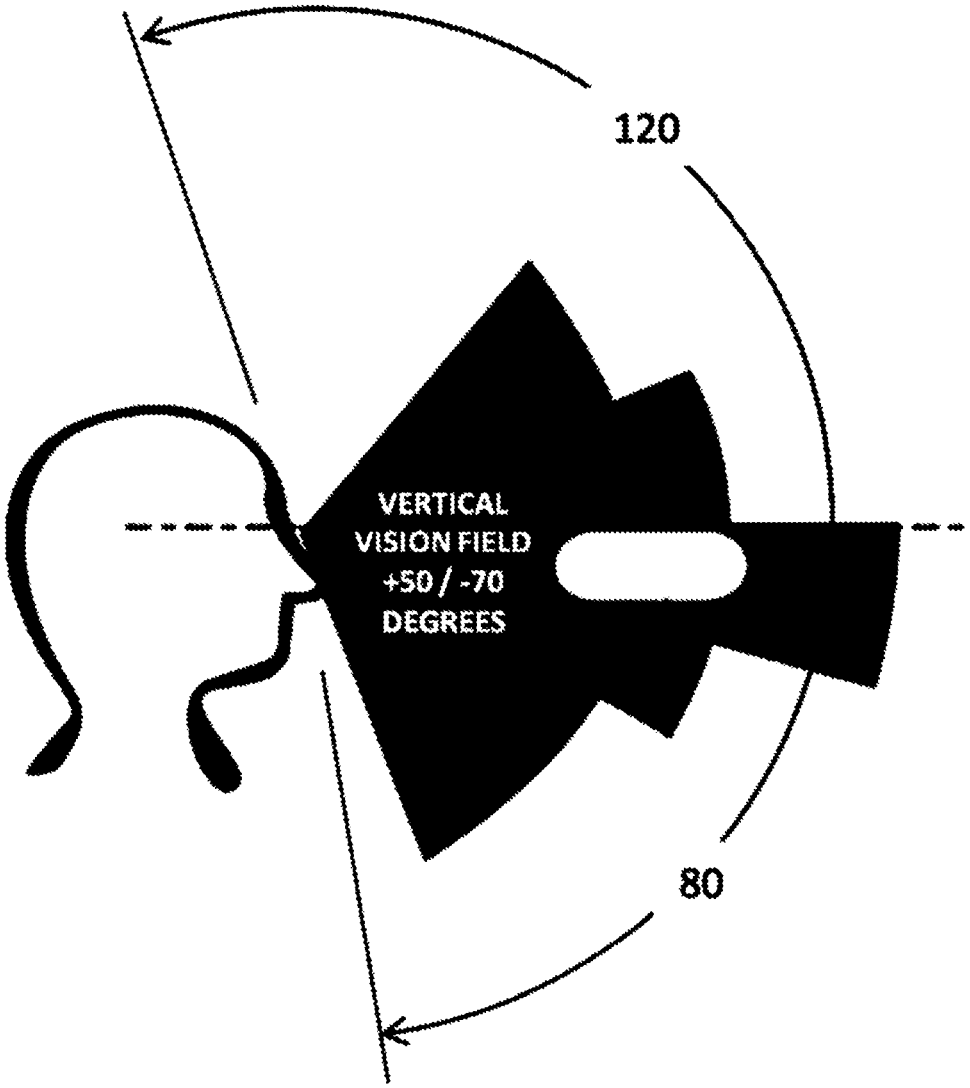
FIG. 12. illustrates a side elevation view of a typical user's vertical vision field, according to an embodiment of the present invention.
Figure 13:
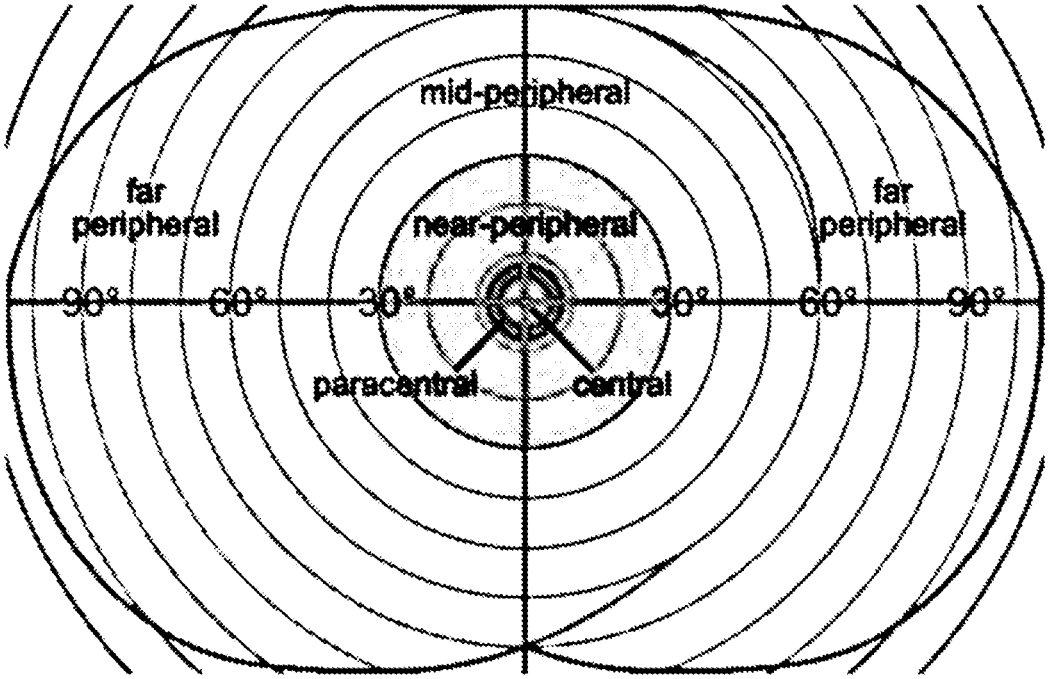
FIG. 13. further illustrates a typical user's vision field, according to an embodiment of the present invention.

FIG. 11, and FIG. 13 illustrate the positioning of the remote phosphor domes 114 from a top plan view, according to an embodiment of the present invention. Positioning of each dome 114 provides for a 240° horizontal array of light—120° in each horizontal direction from the direct frontal line of sight of the user—increasing the user's field of view compared to the prior art. This illuminates the users complete peripheral vision increasing safety in low light environments. The specific positioning is accomplished by the angle of the surface of the pillar 108 which the LED 107 sits upon. Because the remote phosphor dome 114 protrudes from the front cover 101 of the luminaire 100, the dome 114 emits light at the intended array with respect to the user since the dome 114 and light emitted therefrom is not obstructed by any component. FIG. 7, FIG. 8, FIG. 10, and FIG. 11 similarly illustrates the positioning of the remote phosphor domes 114 from a side elevation view, according to an embodiment of the present invention. The angular positioning also permits the vertical viewing field to be optimized. Because each remote phosphor dome 114 rests on the wide angle LED board 113, each dome 114 emits light at the intended array with respect to the user. In an embodiment, light is emitted in a 200° vertical array, in reference to the users vertical vision field. In a preferred embodiment, from the direct line of sight, light is emitted 80° below the line of sight, and 120° above. Once more, the positioning of each dome 114 allows for the illuminated field to be increased.

Figure 14:
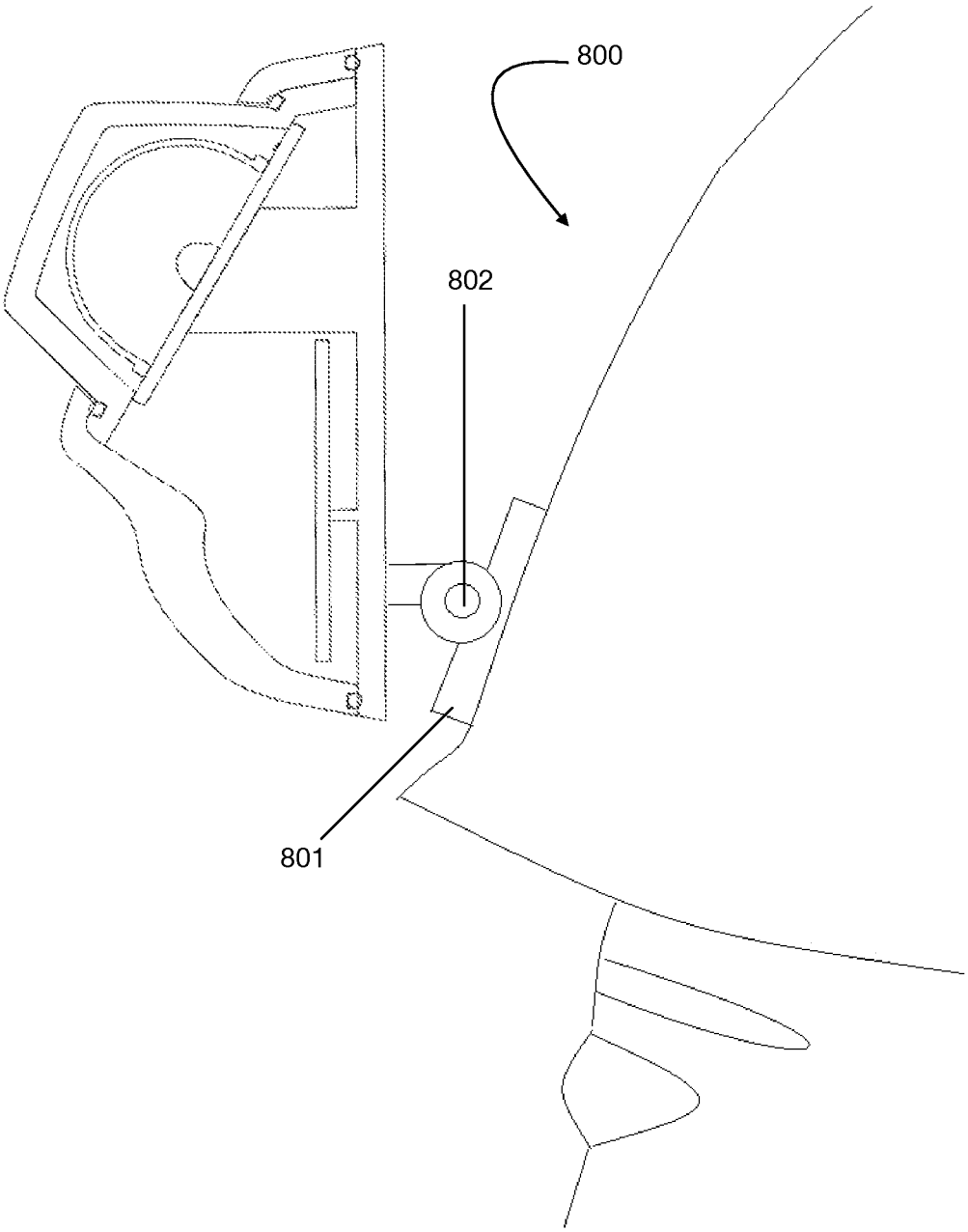
FIG. 14. illustrates the luminaire positioned on a head-wear unit, according to an embodiment of the present invention.

Referring now to FIG. 14, the luminaire 100 is illustrated positioned atop a headwear component 800. While one skilled in the art can realize that a plurality of applications exist for the invention disclosed herein, the useful embodiment of the luminaire mounted to a headlamp is used. In an embodiment, the luminaire is releasably engaged with a surface 800 by a pivoting mount 801. The pivoting mount 801 allows the user to pivot the luminaire to direct light where it is best utilized. In an embodiment, the pivoting mount 801 may have a threaded member 802 disposed between a bracket mechanism, such that as the user tightens the threaded member 802, the bracket is frictionally retained in position. This maintains the luminaire in the user determined position during use. The luminaire 100 may be in electrical communication with an energy storage component adapted to provide power input to the luminaire 100.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiment disclosed herein, but instead as being fully commensurate in scope with the spirit of the invention throughout the description.

The invention claimed is:

1. A luminaire assembly comprising:

a. a housing having a front cover and a back cover, wherein the housing is configured to contain a light assembly therein, the light assembly comprising;

b. a control board operably engaged with one or more wide angle LED's;

c. one or more mixing chambers each comprising a remote phosphor, wherein each of the one or more wide angle LED's are disposed within one of the one or more mixing chambers;

d. a remote phosphor positioned over each of the one or more wide angle LED's, wherein each remote phosphor is retained by a holder; and wherein light emitted from each of the one or wide angle LED's is emitted through one or more transparent surfaces, wherein each transparent surface is disposed over an aperture positioned through the front cover, wherein the luminaire assembly is operably configured to illuminate more than 180° in a horizontal plan, wherein each light assembly is positioned on a pillar extending from the back cover, wherein each pillar transfers heat to the back cover, wherein each light assembly is removably engaged with the a pillar, wherein each pillar extends through an aperture on the control board, wherein each pillar is thermoconductive, wherein each pillar transfers heat to the back cover, and wherein the back cover is configured to be a heat sink.

2. The assembly of claim 1, wherein each wide angle LED and mounted to a board, and wherein the board is comprised of a reflective surface.

3. The assembly of claim 1, wherein the control board is manipulated by a control switch positioned on the housing.

4. The assembly of claim 1, wherein the housing is configured to be mounted to a surface.

5. The assembly of claim 1, wherein the front and back cover sealingly engage to contain the assembly therein.

6. The assembly of claim 1, wherein the holder has at least one remote phosphor retainer and at least one spot LED lens retainer.

7. The assembly of claim 1, wherein each of the at least one transparent surfaces extends to the outside of a vertical plane of the front cover, wherein each of the remote phosphors within the housing are positioned outside of the vertical plane of the front cover such that light emitted by each of the remote phosphors is obstructed by the housing by the less than 180° vertically and 180° horizontally.

8. The assembly of claim 1, wherein each light assembly is removably engaged with the housing.

9. The assembly of claim 1, further comprising at least one spot LED.

* * * * *